US008286433B2

(12) United States Patent
Piper et al.

(10) Patent No.: US 8,286,433 B2
(45) Date of Patent: Oct. 16, 2012

(54) GAS TURBINE FUEL INJECTOR WITH REMOVABLE PILOT LIQUID TUBE

(75) Inventors: James Scott Piper, El Cajon, CA (US); Hongyu Wang, San Diego, CA (US)

(73) Assignee: Solar Turbines Inc., San Diego, CA (US)

( * ) Notice: Subject to any disclaimer, the term of this patent is extended or adjusted under 35 U.S.C. 154(b) by 1166 days.

(21) Appl. No.: 11/976,641

(22) Filed: Oct. 26, 2007

(65) Prior Publication Data

US 2009/0107147 A1 Apr. 30, 2009

(51) Int. Cl.
*F02C 1/00* (2006.01)
*F02G 3/00* (2006.01)

(52) U.S. Cl. ..... 60/742; 60/740; 60/748; 60/739

(58) Field of Classification Search ..... 60/740, 60/742, 748, 739
See application file for complete search history.

(56) References Cited

U.S. PATENT DOCUMENTS

| | | | |
|---|---|---|---|
| 1,526,923 | A | 2/1925 | Meden |
| 2,425,229 | A | 8/1947 | Bremser |
| 2,552,658 | A | 5/1951 | Ackerman |
| 2,881,826 | A | 4/1959 | Spies, Jr. |
| 2,945,629 | A | 7/1960 | Chute et al. |
| 2,968,925 | A | 1/1961 | Blevans et al. |
| 3,310,240 | A | 3/1967 | Grundman |
| 3,330,541 | A | 7/1967 | Jackson |
| 3,398,895 | A | 8/1968 | Claffey |
| 3,458,997 | A | 8/1969 | Clark |

(Continued)

FOREIGN PATENT DOCUMENTS

| | | |
|---|---|---|
| EP | 0564184 | 10/1993 |

(Continued)

OTHER PUBLICATIONS

Jayasuriya, Jeevan; Manrique, Arturo, Gas Turbine Combustor Lab Exercise, Royal Institute of Technology, Jan. 31, 2005, 9 pages, Stockholm.

*Primary Examiner* — William H Rodriguez
*Assistant Examiner* — Craig Kim
(74) *Attorney, Agent, or Firm* — Finnegan, Henderson, Farabow, Garrett & Dunner LLP

(57) ABSTRACT

A fuel injector for a gas turbine engine is disclosed. The fuel injector includes an injector housing having a longitudinal axis. The injector housing includes one or more fuel galleries annularly disposed about the longitudinal axis, and a compressed air inlet. The fuel injector also includes a premix barrel having a proximal end and a distal end circumferentially disposed about the longitudinal axis. The premix barrel is fluidly coupled to the fuel galleries and the compressed air inlet at the proximal end and is configured to couple to a combustor of the gas turbine engine at the distal end. The fuel injector also includes a substantially cylindrical pilot assembly disposed radially inwards of the premix barrel having a first end and a second end. The second end is coupled to the injector housing and the first end is located proximate the distal end of the premix barrel. The fuel injector further includes a pilot liquid tube having a third end and a fourth end disposed radially inwards of the pilot assembly. The fourth end is removably coupled to the injector housing and the third end is located proximate the first end of the pilot assembly.

21 Claims, 7 Drawing Sheets

U.S. PATENT DOCUMENTS

| | | | | |
|---|---|---|---|---|
| 3,684,186 | A | 8/1972 | Helmrich | |
| 4,229,944 | A | 10/1980 | Weiler | |
| 4,365,756 | A | 12/1982 | Fisher | |
| 4,519,372 | A | 5/1985 | Hoffman | |
| 5,337,961 | A | 8/1994 | Brambani et al. | |
| 5,361,578 | A | 11/1994 | Donlan | |
| 5,404,711 | A | 4/1995 | Rajput | |
| 5,423,173 | A | 6/1995 | Lemon et al. | |
| 5,452,574 | A | 9/1995 | Cowell et al. | |
| 5,570,580 | A | 11/1996 | Mains | |
| 5,598,696 | A | 2/1997 | Stotts | |
| 5,706,643 | A | 1/1998 | Snyder et al. | |
| 5,836,163 | A | 11/1998 | Lockyer et al. | |
| 6,003,781 | A | 12/1999 | Kwan | |
| 6,101,814 | A | 8/2000 | Hoke et al. | |
| 6,149,075 | A | 11/2000 | Moertle et al. | |
| 6,357,222 | B1 | 3/2002 | Schilling et al. | |
| 6,434,945 | B1 | 8/2002 | Mandai et al. | |
| 6,460,340 | B1 | 10/2002 | Chauvette et al. | |
| 6,595,000 | B2 | 7/2003 | Lavie et al. | |
| 6,655,145 | B2 | 12/2003 | Boardman | |
| 6,698,207 | B1 | 3/2004 | Wiebe et al. | |
| 6,755,024 | B1 | 6/2004 | Mao et al. | |
| 6,761,035 | B1 | 7/2004 | Mueller | |
| 6,857,271 | B2 | 2/2005 | Kraft et al. | |
| 6,862,888 | B2 | 3/2005 | Akagi et al. | |
| 6,898,926 | B2 | 5/2005 | Mancini | |
| 6,915,638 | B2 | 7/2005 | Runkle et al. | |
| 7,024,861 | B2 * | 4/2006 | Martling | 60/737 |
| 7,117,675 | B2 | 10/2006 | Kaplan et al. | |
| 7,690,203 | B2 * | 4/2010 | Bland | 60/737 |
| 2002/0073708 | A1 * | 6/2002 | Lavie et al. | 60/740 |
| 2002/0138969 | A1 | 10/2002 | Dallmeyer et al. | |
| 2002/0148230 | A1 | 10/2002 | Halila et al. | |
| 2004/0055306 | A1 | 3/2004 | North et al. | |
| 2004/0177615 | A1 | 9/2004 | Martling | |
| 2004/0195389 | A1 | 10/2004 | Neumaier et al. | |
| 2005/0039460 | A1 | 2/2005 | Sobieski et al. | |
| 2007/0039329 | A1 | 2/2007 | Abreu et al. | |
| 2007/0130955 | A1 | 6/2007 | Vandale et al. | |
| 2007/0214790 | A1 | 9/2007 | Bland | |
| 2008/0066720 | A1 * | 3/2008 | Piper et al. | 123/470 |
| 2008/0083229 | A1 | 4/2008 | Haynes et al. | |
| 2009/0107147 | A1 | 4/2009 | Piper et al. | |
| 2009/0133402 | A1 | 5/2009 | Piper et al. | |

FOREIGN PATENT DOCUMENTS

| | | |
|---|---|---|
| EP | 1323982 | 7/2003 |
| EP | 1493970 | 1/2005 |
| EP | 1672282 | 6/2006 |
| WO | WO 01/55646 | 8/2001 |
| WO | 2008033542 | 3/2008 |

* cited by examiner

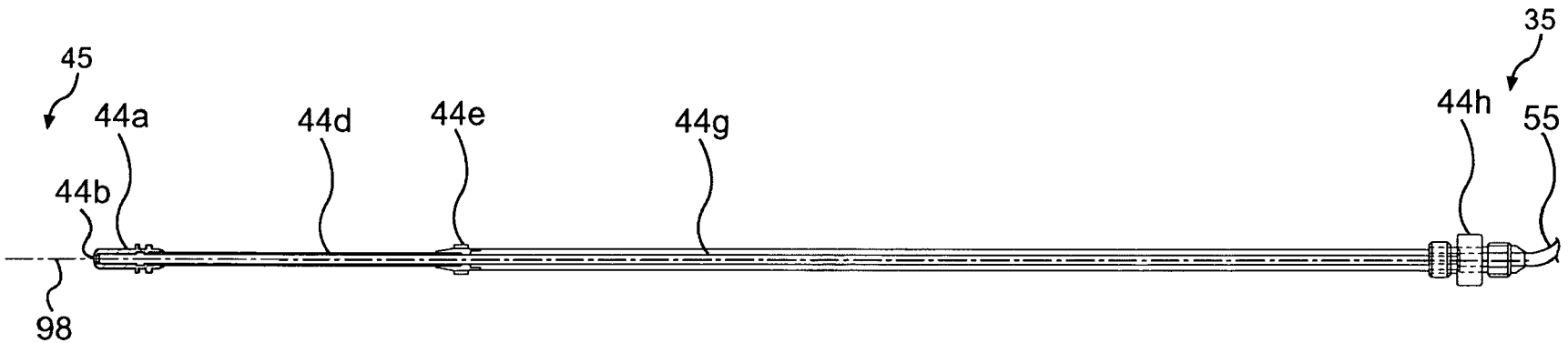
FIG. 5A
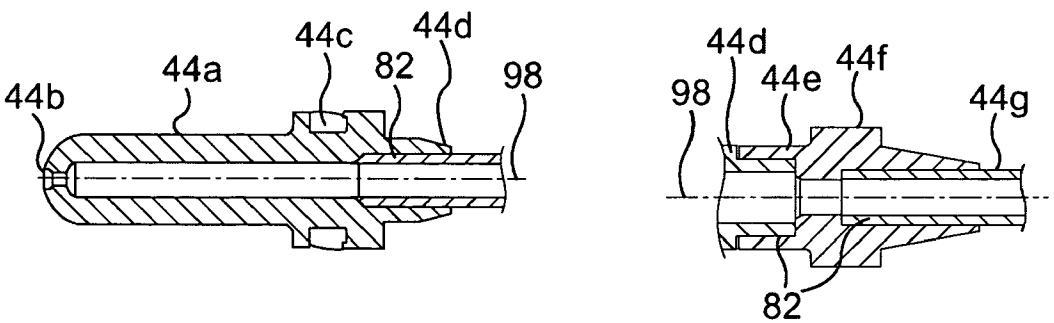
FIG. 5B
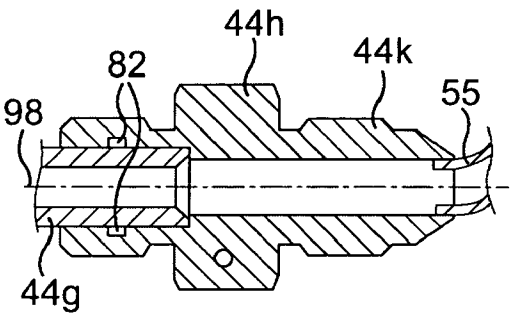
FIG. 5C
FIG. 5D

GAS TURBINE FUEL INJECTOR WITH REMOVABLE PILOT LIQUID TUBE

TECHNICAL FIELD

The present disclosure relates generally to a fuel injector for a gas turbine engine, and more particularly, to a gas turbine fuel injector with a removable pilot liquid tube.

BACKGROUND

Gas turbine engines ("GTE's") produce power by extracting energy from a flow of hot gas produced by combustion of fuel in a stream of compressed air. In general, GTE's have an upstream air compressor coupled to a downstream turbine with a combustion chamber ("combustor") in between. Energy is released when a mixture of compressed air and fuel is ignited in the combustor. The resulting hot gases are directed over the turbine's blades, spinning the turbine, thereby, producing mechanical power. In typical GTE's, one or more fuel injectors direct some type of fossil fuel into the combustor for combustion. Combustion of fossil fuel results in the production of some undesirable constituents in exhaust emissions. These undesirable constituents include nitrogen oxide (NO) and nitrogen dioxide ($NO_2$), which are collectively referred to as $NO_x$. In some countries, government regulations restrict the allowable level of $NO_x$ that may emitted by GTE's.

The amount of $NO_x$ emissions from a GTE increases with the flame temperature in the combustor. Therefore, one technique used by GTE manufacturers to meet $NO_x$ regulations is to reduce the flame temperature in the combustor of the GTE. Low flame temperature in the combustor may be achieved by reducing the fuel content in the fuel-air mixture fed to the combustor and by thoroughly mixing the fuel in the air before the fuel-air mixture is directed to the combustor. Such a well mixed fuel-air mixture with lower fuel content is referred to as a lean premixed mixture. While this lean premixed mixture reduces $NO_x$ emissions, reducing the fuel content in the mixture below a threshold value may cause the resulting flame to be unstable. The unstable flame may cause undesirable pressure oscillations within the combustor, eventually leading to smothering of the flame (called "lean blow-out").

To provide a stable flame while meeting $NO_x$ emission regulations, some GTE fuel injectors provide for multiple fuel paths or fuel streams, such as a main fuel stream and a pilot fuel stream. In such a system, the main fuel stream provides lean premixed fuel to the combustor for low $NO_x$ operation, while the pilot fuel stream provides a source of rich fuel for flame stabilization and startup. The fuel delivered through these fuel streams may be liquid or gaseous. Some fuel injectors may also have the capability to deliver both liquid and gaseous fuel to the GTE. Due to the proximity of the fuel injector to the combustor, liquid fuel tubes providing liquid fuel to the pilot assembly (called pilot liquid tube) of the fuel injector may experience high temperatures during GTE operation. In addition to potential thermal damage to fuel injector components due to high temperature, prolonged exposure to these high temperatures may cause the pilot liquid tube to clog over time due to fuel coking. Damage caused to the pilot liquid tube may sometimes necessitate removal and cleaning of the tube in the field.

U.S. Pat. No. 5,404,711 ('711 patent), a patent issued to the assignee of the current disclosure, on Apr. 11, 1995, describes a GTE fuel injector with main and pilot fuel streams. While the injector of the '711 patent has proven to be reliable and robust, and has achieved wide commercial success, the pilot components of the '711 patent are permanently attached to the rest of the injector structure to provide a good seal against fuel and air leakage. Since the pilot assembly of the '711 patent likely experiences high temperatures due to its proximity to the combustion flame, liquid fuel lines may be susceptible to clogging due to coking. While the permanent attachment of the pilot components of the '711 patent prevents fuel and air leakage, removal and cleaning of liquid fuel lines in a field environment becomes difficult. The present disclosure is directed to solving one or more of the problems set forth above.

SUMMARY OF THE INVENTION

In one aspect, a fuel injector for a gas turbine engine is disclosed. The fuel injector includes an injector housing having a longitudinal axis. The injector housing includes one or more fuel galleries annularly disposed about the longitudinal axis, and a compressed air inlet. The fuel injector also includes a premix barrel having a proximal end and a distal end circumferentially disposed about the longitudinal axis. The premix barrel is fluidly coupled to the fuel galleries and the compressed air inlet at the proximal end and is configured to couple to a combustor of the gas turbine engine at the distal end. The fuel injector also includes a substantially cylindrical pilot assembly disposed radially inwards of the premix barrel having a first end and a second end. The second end is coupled to the injector housing and the first end is located proximate the distal end of the premix barrel. The fuel injector further includes a pilot liquid tube having a third end and a fourth end disposed radially inwards of the pilot assembly. The fourth end is removably coupled to the injector housing and the third end is located proximate the first end of the pilot assembly.

In another aspect, a method of assembling a fuel injector of a gas turbine engine is disclosed. The method includes inserting a first end of a pilot liquid tube into a cavity that extends longitudinally from a back end to a front end of the fuel injector. The method also includes moving the pilot liquid tube into the cavity until the first end is proximate the front end of the fuel injector and a second end of the pilot liquid tube opposite the front end abuts the back end of the fuel injector. The method further includes rotating the pilot liquid tube about a longitudinal axis of the fuel injector to removably couple the pilot liquid tube to the fuel injector.

In another aspect, a gas turbine engine is disclosed. The gas turbine engine includes a compressor and a combustor fluidly coupled to the compressor. The gas turbine engine also includes a fuel injector having a longitudinal axis coupled to the combustor. The fuel injector includes a housing having a front end and a back end. The housing also includes a first cavity disposed about the longitudinal axis extending from the front end to the back end. The fuel injector also includes a substantially cylindrical premix barrel disposed circumferentially about the longitudinal axis. The premix barrel is coupled to the housing at one end and coupled to the combustor at an opposite end. The fuel injector also includes a substantially cylindrical pilot assembly disposed radially inwards of the premix barrel. The pilot assembly includes a second cavity disposed about the longitudinal axis and passing longitudinally through the pilot assembly. The fuel injector further includes an elongate pilot liquid tube disposed about the longitudinal axis. The pilot liquid tube is removably coupled to the housing and extends through the first cavity and the second cavity to a location proximate the combustor. The gas turbine engine also includes a turbine fluidly coupled to the combustor.

In yet another aspect, a component for turbine engine fuel injector is disclosed. The component includes an elongate section having a longitudinal axis and extending from a first end to a second end. The component also includes a nozzle coupled to the first end. The nozzle includes helical grooves on an external surface. The component also includes a standoff fixture between the first end and the second end. The standoff fixture includes a plurality of spokes extending radially outwards from an external surface of the standoff fixture. The component further includes a tube fitting coupled to the second end, the tube fitting having screw threads on an external surface of the tube fitting.

BRIEF DESCRIPTION OF THE DRAWINGS

FIG. 5A-5D are illustrations of corresponding cross-sectional views of the pilot liquid tube illustrated in FIGS. 4A-4D;

DETAILED DESCRIPTION

Figure 1:
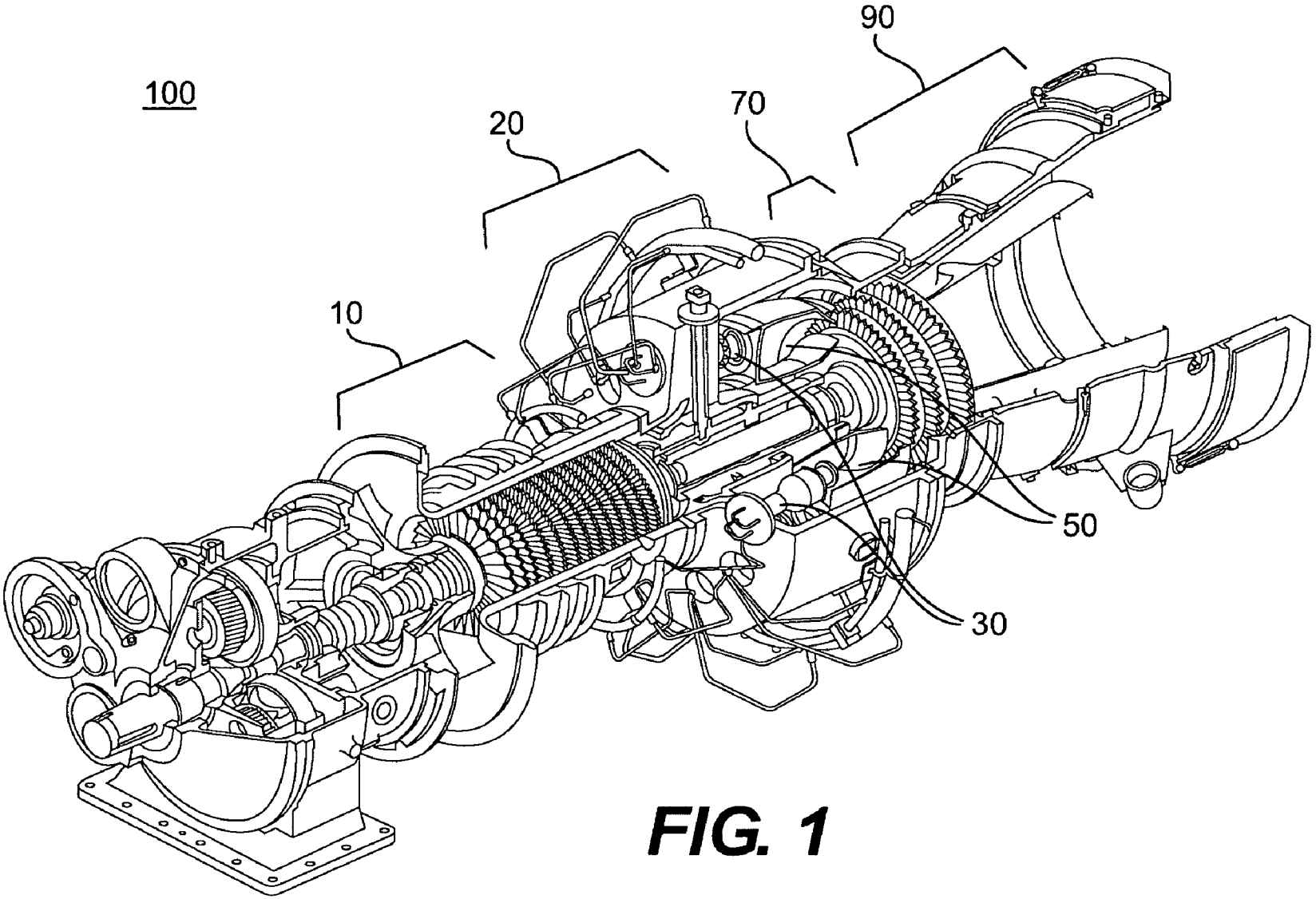
FIG. 1 is an illustration of an exemplary disclosed gas turbine engine system.

FIG. 1 illustrates an exemplary gas turbine engine (GTE) 100. GTE 100 may have, among other systems, a compressor system 10, a combustor system 20, a turbine system 70, and an exhaust system 90. In general, compressor system 10 compresses incoming air to a high pressure, combustor system 20 mixes the compressed air with a fuel and burns the mixture to produce high-pressure, high-velocity gas, and turbine system 70 extracts energy from the high-pressure, high-velocity gas flowing from the combustor system 20. The compressed air from compressor system 10 is mixed with fuel in a plurality of fuel injectors 30 before being directed to one or more combustors 50 of combustor system 20. The fuel injectors 30 may include multiple flow paths to deliver fuel to combustor 50. One of these flow paths (primary flow path) may deliver fuel premixed with compressed air to combustor 50. Another flow path may separately inject a fine spray of fuel and compressed air into combustor 50 (pilot flow path).

The fuel delivered to combustor 50 may undergo combustion to form a high pressure mixture of combustion byproducts. Energy may be extracted from this high temperature and high pressure mixture in turbine system 70. The combustion gases may then be discharged to the atmosphere through exhaust system 90. Any liquid or gaseous fuel may be used with GTE 100. Typically used liquid fuels may include diesel, heizol EL (extra light), gas oil, jet propellant, or kerosene, and typically used gaseous fuels may include natural gas. However, it is also contemplated that alternative liquid fuels such as, natural gas liquids (ethane, propane, butane, etc.), paraffin oil based fuels (JET-A, etc.), gasoline, etc., and alternative gaseous fuels such as liquefied petroleum gas (LPG), ethylene, ammonia, biomass gas, coal gas, etc. may also be used in GTE 100.

Combustion of the hydrocarbon based fuel in combustor 50 may produce byproducts such as $NO_x$, carbon monoxide (CO), carbon dioxide ($CO_2$), and un-burnt hydrocarbons. Government regulations may limit the amount of $NO_x$ that may be discharged by GTE 100. Formation of $NO_x$ in combustor 50 may result from a reaction between fuel and air at high temperatures. $NO_x$ formation may be reduced by reducing flame temperature during combustion. However, reducing the temperature of the flame may make the flame susceptible to being extinguished (that is, susceptible to lean blowout). One technique used by GTE manufacturers to prevent lean blow out while maintaining a low flame temperature (for low $NO_x$ emissions), is to deliver an additional fuel stream to combustor 50. This additional fuel stream may be richer in fuel content and may burn at a higher temperature. This hotter flame may serve as a hot spot to stabilize the combustion process and thereby prevent lean blowout.

Figure 2:
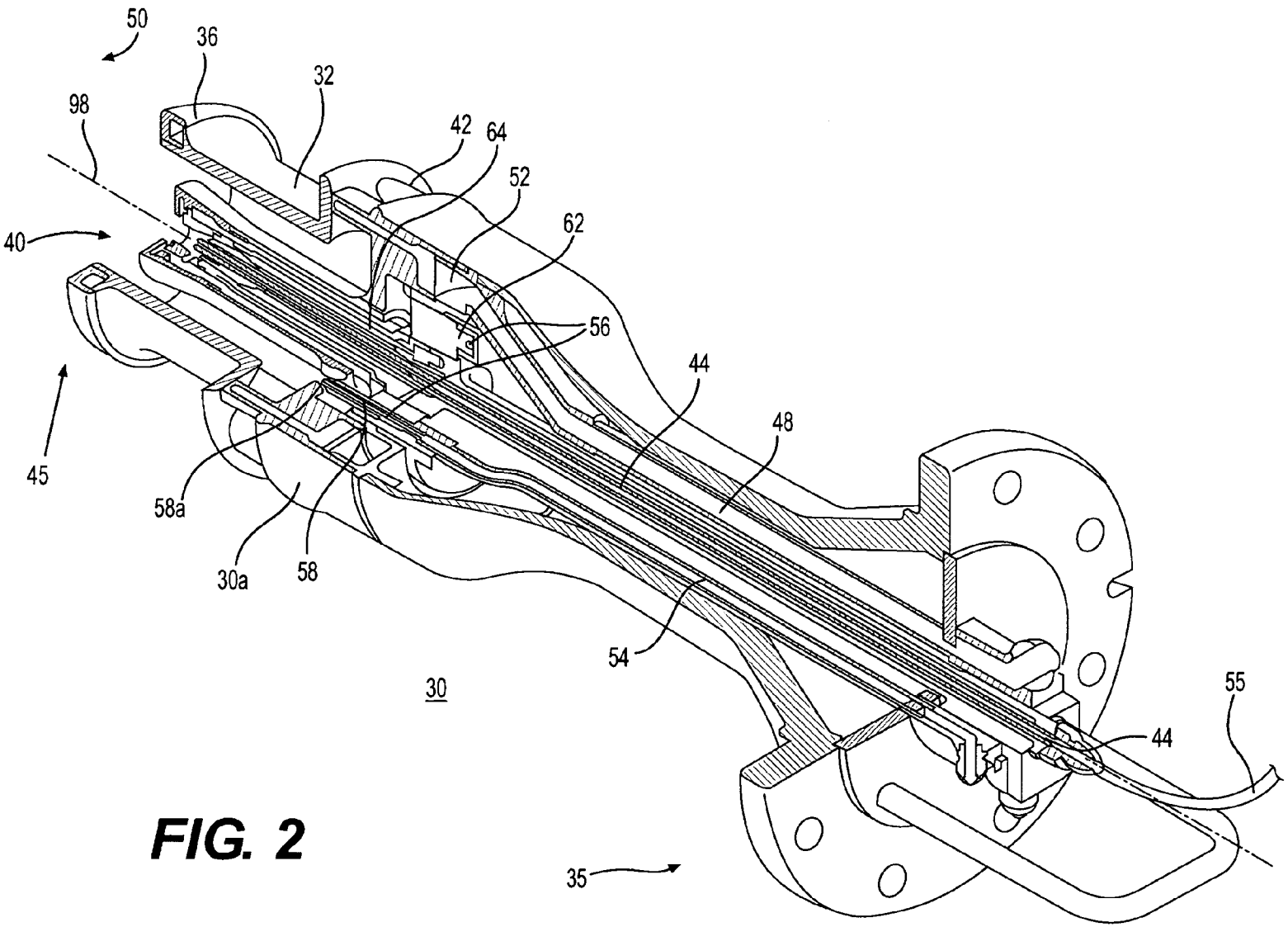
FIG. 2 is an exploded view of a fuel injector in the GTE of FIG. 1.

FIG. 2 is an illustration of a fuel injector 30. Fuel injector 30 may include multiple components assembled together. These multiple components may include, among others, a premix barrel 32, a pilot assembly 40, and a pilot liquid tube 44 coupled to a fuel injector housing 30*a* to form fuel injector 30. Fuel injector 30 may include a first end 45 coupled to combustor 50 and a second end 35 opposite first end 45. The components of fuel injector 30 may cooperate to deliver gaseous and/or liquid fuel and compressed air to combustor 50. In some embodiments, the fuel supply may be switched between gaseous and liquid fuels to suit operating conditions of GTE 100. For instance, at an operating site with an abundant supply of natural gas, fuel injector 30 may deliver liquid fuel to combustor 50 during start up and later switch to gaseous fuel to utilize the locally available fuel supply. Fuel injectors capable of delivering both liquid and gaseous fuels to combustor 50 are sometimes referred to as dual fuel injectors. In this disclosure, the term fuel injector is used to refer to fuel injectors that may deliver liquid fuel to GTE's (that is, liquid fuel injectors and dual fuel injectors). Fuel injector 30 may also include multiple flow paths that may deliver multiple streams of fuel to combustor 50. In some embodiments, these multiple flow paths may include a main fuel flow path and a pilot fuel flow path. The concentration (of fuel in air) and amount of fuel delivered to combustor 50 through the main fuel flow and the pilot fuel flow paths may be varied by a control system of GTE 100.

In the embodiment illustrated in FIG. 2, fuel injector 30 may have a generally tubular configuration with an inner and an outer tube arranged concentrically about longitudinal axis 98. The outer tube of fuel injector 30 may comprise premix barrel 32 and the inner tube may comprise pilot assembly 40. As described earlier, premix barrel 32 may deliver the main fuel stream (premixed air-fuel mixture) to combustor 50 while pilot assembly 40 may deliver the pilot fuel stream (pressurized fuel along with compressed air) to combustor 50. The tubular premix barrel 32 may be circumferentially disposed around the pilot assembly 40, and both premix barrel 32 and pilot assembly 40 may be centered about longitudinal axis 98.

Compressed air from compressor system 10 may be directed to fuel injector 30 through an air swirler 42. Air swirler 42 may include a plurality of curved blades attached to fuel injector housing 30*a* to swirl the incoming compressed air. The number of curved blades in an air swirler of a fuel injector may depend upon the specific characteristics of GTE 100, some embodiments of fuel injectors may have twelve curved blades while others may have a different number of blades. Although air swirler 42 in FIG. 2 is illustrated as a radial swirler, air swirler 42 in general, may include a radial or an axial swirler. A radial swirler is an air swirler in which compressed air from compressor system 10 may be directed to the curved blades radially, while an axial swirler is an air swirler in which the compressed air may be directed to the curved blades axially.

Premix barrel 32 may include an elongate tubular section with two opposing end sections. An end section of premix barrel 32 at first end 45 may include an end cap 36 coupled first thereto. The end section with end cap 36 may be coupled to combustor 50 such that a central opening fluidly communicates premix barrel 32 with combustor 50. An end section opposite end cap 36 may be coupled to fuel injector housing 30*a*. Liquid and/or gaseous fuel may be injected into the swirled air stream in premix barrel 32 to mix with the compressed air. Swirling the compressed air may help mix the fuel thoroughly with the compressed air. The premixed air-fuel mixture may be directed to combustor 50 through premix barrel 32. The premixed air-fuel mixture may create premixed flames within combustor 50. Premixed flames are flames that are created when fuel and air are first mixed in fuel injector 30 and then burned in combustor 50. As discussed earlier, in embodiments where low $NO_x$ emission is desired, the flame temperature of these premixed flames may be reduced by delivering a lean premixed air-fuel mixture through premix barrel 32.

Main gas tube 48 may supply gaseous fuel from a gas manifold (not shown) to a main gas gallery 52 included in fuel injector housing 30*a*. Main gas gallery 52, annularly positioned around longitudinal axis 98, may feed the gaseous fuel to gas ports that may be located proximate to air swirler 42. Gas ports may be small holes located on the blades of air swirler 42, upstream of air swirler 42, or down stream of air swirler 42. These gas ports may provide gaseous fuel for the main fuel stream of fuel injector 30.

Liquid tube 54 may supply liquid fuel from a liquid fuel supply (not shown) to a main liquid gallery 56 included in housing 30*a*. Main liquid gallery 56 may include an annular channel around longitudinal axis 98 fluidly coupled to one or more liquid fuel nozzles 58 annularly arranged, at substantially constant spacing, around longitudinal axis 98. A nozzle tip 58*a* of liquid fuel nozzle 58 may be configured to spray the liquid fuel into the swirled compressed air proximate air swirler 42. In some embodiments, the number of liquid fuel nozzles 58 may be half the number of blades on air swirler 42, and may be positioned proximate every alternate blade of air swirler 42. The swirled compressed air stream downstream of air swirler 42 may help atomize the liquid fuel sprayed from nozzle tip 58*a*. The compressed air and the sprayed liquid fuel may mix thoroughly in premix barrel 32 to form the premixed air-fuel mixture. In some embodiments, gaseous fuel (from the gas ports) may be mixed with compressed air to form the premixed air-fuel mixture. In some embodiments, a liquid fuel-air mixture may be provided for part of the operation while a gaseous fuel-air mixture may be provided for another part.

Pilot assembly 40 may be disposed radially inwards of premix barrel 32, and coupled to housing 30*a*. Pilot assembly 40 may include components configured to inject a stream of pressurized fuel and a stream of compressed air into combustor 50. The fuel delivered through pilot assembly 40 may include a spray of liquid fuel and a spray of compressed air. In dual fuel injectors, pilot assembly 40 may be configured to deliver both liquid and gaseous fuel to combustor 50. Pilot assembly 40 may also include swirl features (described later) to swirl the compressed air delivered to combustor 50 through pilot assembly 40. The pressurized stream of fuel and air delivered through pilot assembly 40 may comprise the pilot fuel flow. This pressurized stream of fuel and air may create a diffusion flame in combustor 50. Diffusion flames are flames that are created when fuel and air mix and burn at the same time. Diffusion flames may have a higher flame temperature than premixed flames, and may serve as a localized hot flame to stabilize the combustion process and prevent lean blowout.

Figure 3:
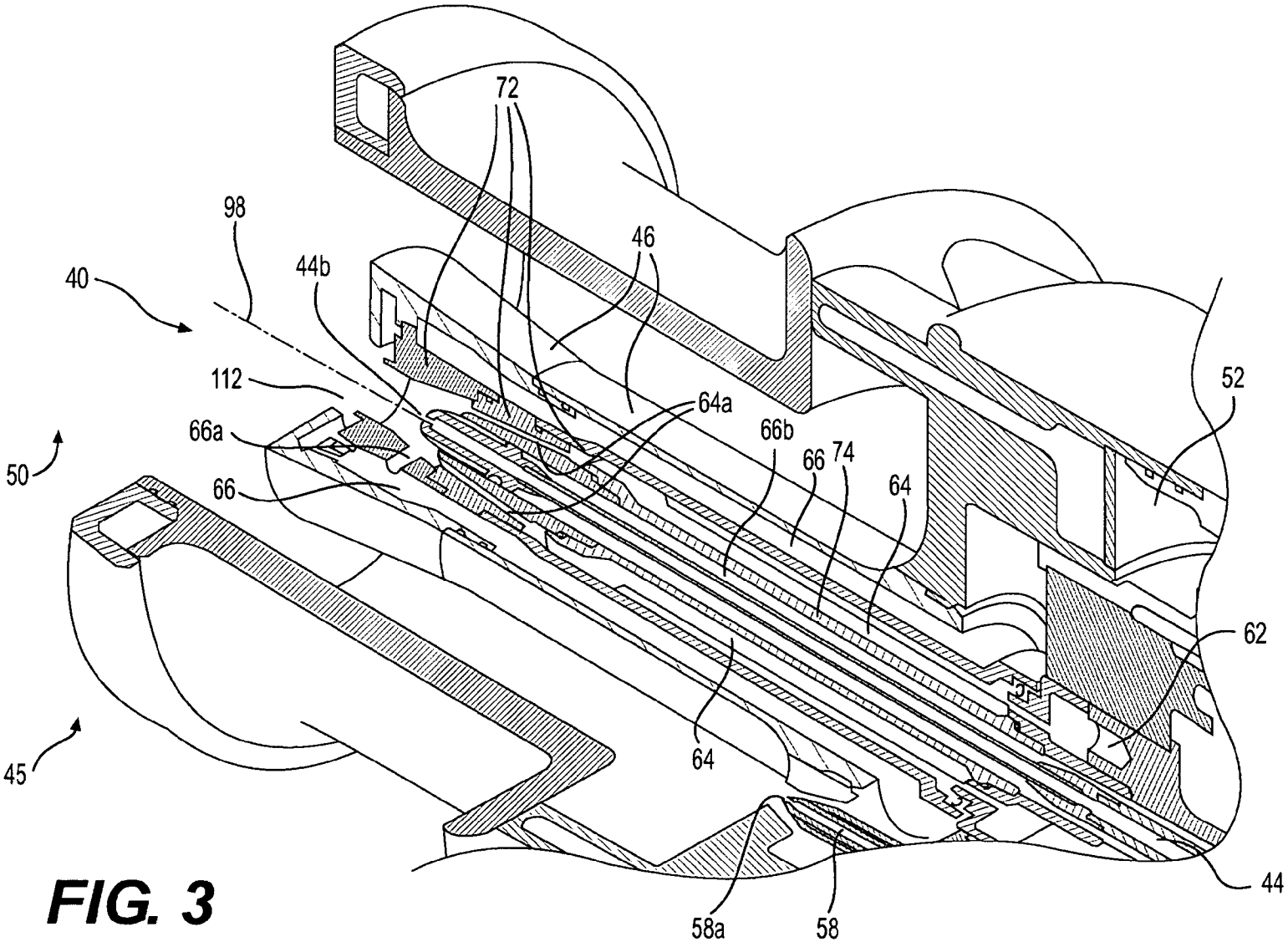
FIG. 3 is an exploded view of the pilot assembly of the fuel injector of FIG. 2.

FIG. 3 illustrates an exploded view of pilot assembly 40. Reference will be made to both FIGS. 2 and 3 in the description that follows. Pilot assembly 40 may generally have a tubular configuration with an outer tube, a middle tube and an inner tube arranged concentrically about longitudinal axis 98. The outer tube of pilot assembly 40 may include an inner premix tube 46 disposed radially outwards of a gas pilot shroud 72, which comprises the middle tube. The inner tube may include an air assist shroud 74 disposed radially inwards of gas pilot shroud 72. Inner premix tube 46, gas pilot shroud 72 and air assist shroud 74 may together form pilot assembly 40. Pilot assembly 40 may include fuel and compressed air conduits that direct fuel and air to combustor 50 through pilot assembly 40.

The fuel and compressed air conduits of pilot assembly 40 may include gaseous and liquid fuel lines that provide fuel for the pilot flow path. Main gas gallery 52 may supply gaseous fuel to pilot gas gallery 62. Pilot gas gallery 62 may also be annularly located around longitudinal axis 98. Pilot gas gallery 62 may direct gaseous fuel to pilot gas duct 64. Pilot gas duct 64 may be an annular duct around longitudinal axis 98 and may include one or more pilot gas nozzles 64*a*. Pilot gas nozzles 64*a* may include openings arranged annularly around longitudinal axis 98 that may direct gaseous fuel from pilot gas duct 64 to combustor 50. Primary pilot air duct 66 may also direct compressed air into pilot assembly 40 through pilot air nozzle 66*a*. Primary pilot air duct 66 may be an annular duct arranged about longitudinal axis 98 with a plurality of pilot air nozzles 66*a* fluidly coupled thereto. Each pilot air nozzle 66*a* may be positioned proximate a pilot gas nozzle 64*a*. The proximate positioning of pilot gas nozzle 64*a* and pilot air nozzle 66*a* may assist in mixing the pilot gas stream with compressed air before being directed to combustor 50. Pilot assembly 40 may also include a secondary pilot air duct 66*b* configured to deliver compressed air to combustor 50. Secondary pilot air duct 66*b* may be an annular duct arranged about longitudinal axis 98 and may be positioned radially inwards of primary pilot air duct 66.

Pilot liquid tube 44 may direct liquid fuel from outside fuel injector 30 to pilot assembly 40. Pilot liquid tube 44 may be an elongate assembly removably coupled to fuel injector 30, and having a longitudinal axis concentric with longitudinal axis 98. Pilot liquid tube 44 may be positioned radially inwards of pilot assembly 40. In some embodiments, pilot liquid tube 44 may be centrally positioned in fuel injector 30. Secondary pilot air duct 66*b* may be formed by the space between pilot liquid tube 44 and air assist shroud 74 of pilot assembly 40. The liquid fuel delivered to pilot assembly 40 through pilot liquid tube 44 may be sprayed into combustor 50 through pilot liquid nozzle 44*b* at the tip of pilot liquid tube 44. Compressed air from secondary pilot air duct 66*b* may also be injected into combustor 50 alongside the fuel spray through openings (not shown) in pilot air duct 66*b* around pilot liquid tube 44. This liquid fuel spray and compressed air burn to form the diffusion flame in combustor.

Figure 4A:
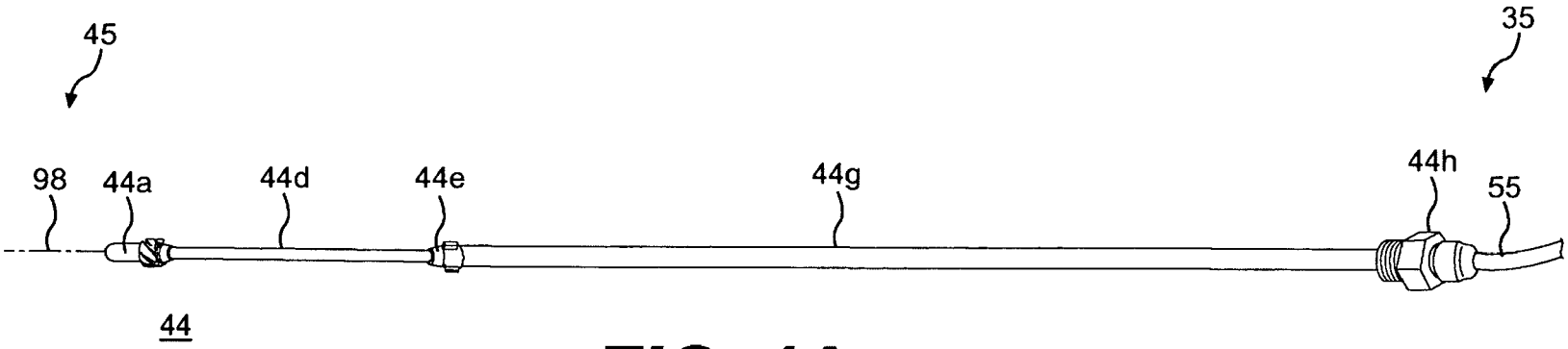
FIG. 4A-4D are illustrations of external views of a pilot liquid tube of the fuel injector of FIG. 2.

FIGS. 4A-4D illustrates external views of pilot liquid tube 44, and FIGS. 5A-5D show corresponding cross-sectional views of the pilot liquid tube 44. FIGS. 4A and 5A show a view of the entire pilot liquid tube 44, while FIGS. 4B-5D show enlarged views of selected regions of pilot liquid tube 44. Reference will be made to FIGS. 4A-5D in the discussion that follows.

Liquid fuel from a liquid fuel distribution block (not shown) may be directed into fuel injector 30 through a liquid fuel pipe 55. Liquid fuel pipe 55 may be constructed of any material known in the art. In some embodiments, liquid fuel pipe 55 may be a metallic pipe. Pilot liquid tube 44 may include an assembly formed from multiple components that may be removably coupled to fuel injector 30 and configured to deliver liquid fuel from liquid fuel pipe 55 to first end 45 of fuel injector 30.

Figure 4D:
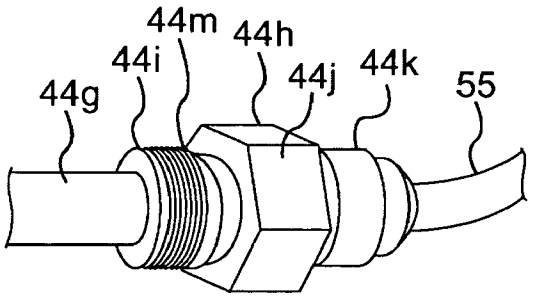
Figure 4C:
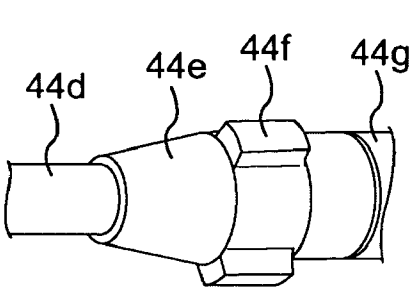
Figure 4B:
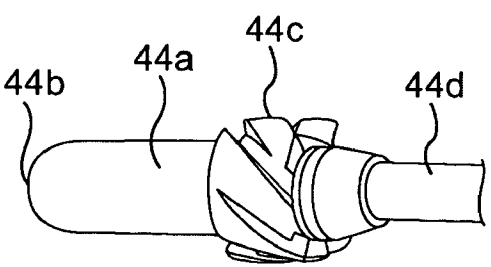

At first end 45, pilot liquid tube 44 may include a swirler tip 44*a* with a pilot liquid nozzle 44*b* passing there-through. An external view of swirler tip 44*a* is illustrated in FIG. 4B and a cross-sectional view is illustrated in FIG. 5B. The liquid fuel delivered through pilot liquid tube 44 may be sprayed into combustor 50 through pilot liquid nozzle 44*b*. Compressed air from secondary pilot air duct 66*b* may also be injected into combustor through openings at first end 45 of secondary pilot air duct 66*b* positioned around swirler tip 44*a*. Swirler tip 44*a* may include swirl features 44*c* on an external surface. These swirl features 44*c* may project into secondary pilot air duct 66*b* and may swirl the compressed air exiting secondary pilot air duct 66*b*. In some embodiments, swirl features 44*c* may include a feature with helical grooves machined on swirler tip 44*a*. However, other methods of construction of swirl features 44*c* are also contemplated. These helical grooves may swirl the compressed air delivered through pilot air duct 66*b*. Swirler tip 44*a* may be constructed of any material, such as, for example, stainless steel grade 316L (low carbon version of grade 316). However, other materials may also be used to construct swirler tip 44*a*.

Swirler tip 44*a* may be attached to a first tube 44*d* that extends from a proximal end of swirler tip 44*a* towards second end 35 of fuel injector. Attaching first tube 44*d* to swirler tip 44*a* may include brazing swirler tip 44*a* to first tube 44*d*. In the embodiment depicted in FIGS. 4B and 5B, first tube 44*d* is inserted into a cavity at the proximal end of swirler tip 44*a* and brazed therein. The brazed joint 82 may form a substantially liquid-tight seal that allows liquid fuel to flow through pilot liquid tube 44 without leaking. In some embodiments, other methods may be used to attach swirler tip 44*a* to first tube 44*d*. First tube 44*d* may include an elongate tubular section, with a longitudinal axis collinear with longitudinal axis 98, that terminates at a standoff fixture 44*e*. A proximal end of first tube 44*d* may be brazed to standoff fixture 44*e* to form a substantially liquid-tight seal. However, other methods of creating a liquid tight seal may be used to attach first tube 44*d* to standoff fixture 44*e*. Although first tube 44*d* may be made of any material, in some embodiments, it may be made of temperature resistant material, such as, for example, Inconel 625.

Standoff fixture 44*e* may include a coupling configured to couple two tubes together. An external view of standoff fixture 44*e* is illustrated in FIG. 4C and a cross-sectional view is illustrated in FIG. 5C. A distal end of standoff fixture 44*e* may couple with first tube 44*d* and a proximal end of standoff fixture 44*e* may couple with a second tube 44*g*. In some embodiments, a brazed joint 82 may attach first tube 44*d* with standoff fixture 44*e*. Standoff fixture 44*e* may also include standoff features, such as spokes 44*f*, on an external surface of standoff fixture 44*e*. Spokes 44*f* may include a plurality of arms extending radially outwards from an external surface of standoff fixture 44*e*. These spokes 44*f* may be configured to position pilot tube 44 in secondary pilot air duct 66*b* while allowing compressed air to flow between the spokes 44*f*.

The proximal end of standoff fixture 44*e* may be attached to second tube 44*g*. In some embodiments, second tube 44*g* may be inserted into a cavity at the proximal end of standoff fixture 44*e* and brazed therein (forming a brazed joint 82) to create a liquid-tight seal. However, other methods of forming leak free connections are also contemplated. Second tube 44*g* may extend from standoff fixture 44*e* towards second end 35 of fuel injector 30. Second tube 44*g* may include an elongate tubular section, with a longitudinal axis collinear with longitudinal axis 98. In some embodiments, second tube 44*g* may be longer than first tube 44*d*. In these embodiments, an external diameter of second tube 44*g* may be larger than an external diameter of first tube 44*d*. The larger external diameter of second tube 44*g* may enhance the structural stability of pilot liquid tube 44. In some embodiments, second tube 44*g* may be made of stainless steel 316L. However, any temperature resistant material may be used to construct second tube 44*g*. At second end 35 of fuel injector 30, second tube 44*g* may be attached to a tube fitting 44*h*. In some embodiments, second tube 44*g* may be brazed to tube fitting 44*h*. In some embodiments, standoff features may also be included on an external surface of second tube 44*g* to assist in locating pilot liquid tube 44 in secondary pilot air duct 66*b*.

Tube fitting 44*h* may include a coupling configured to couple second tube 44*g* to liquid fuel pipe 55. An external view of tube fitting 44*h* is illustrated in FIG. 4D and a cross-sectional view is illustrated in FIG. 5D. Tube fitting 44*h* may include a first section 44*i*, a second section 44*j*, and a third section 44*k* arranged longitudinally along longitudinal axis 98. First section 44*i* may include a longitudinal cavity at one end configured to braze second tube 44*g* therein. An external surface of first section may also include external screw threads 44*m* configured to couple tube fitting 44*h* with fuel injector 30. Second section 44*j* may be coupled with first section 44*i*, and may include flat surfaces on an external surface. In some embodiments, these flat surfaces may be arranged similar to a bolt and may be configured to engage with a tool, such as a wrench or a spanner. These flat surfaces may assist in coupling pilot liquid tube 44 with fuel injector 30. Third section 44*k* of tube fitting 44*h* may be coupled with second section 44*h* and with liquid fuel pipe 55. In some embodiments, third section 44*k* may include a cavity configured to receive liquid fuel pipe 55. In some embodiments, liquid fuel pipe 55 may be brazed with third section 44*k* form a leak free connection. However, other methods of forming leak free connections may be used to couple liquid fuel pipe 55 with tube fitting 44*h*. In general, any material, such as, stainless steel 316L, inconel 625, etc., may be used for tube fitting 44*h*. In some embodiments, tube fitting 44*h* may be made of bronze.

Braze joint 82 may formed by any braze material (such as, AMS 4775, AMS 4776, AMS 4777, AMS 4778, AMS 4779, AMS 4782, 82% Au 18% Cu, 80% Au 20% Cu, 50% Au 50% Cu, 37.5% Au 62.5% Cu, 35% Au 62% Cu 3% Ni, 30% Au 70% Cu, 72% Ag 28% Cu (Ag/Cu Eutectic), 68% Ag 27% Cu 5% Pd, 59% Ag 31% Cu 10% Pd, 65% Ag 20% Cu 15% Pd, 54% Ag 21% Cu 25% Pd, MARM 002, MARM 509, MARM 509B, X40, etc.). In some embodiments, braze alloy AMS 4782 may be used as the braze material.

Swirler tip 44*a*, first tube 44*d*, standoff fixture 44*e*, second tube 44*g* and tube fitting 44*h* may be assembled together to form pilot liquid tube 44. Pilot liquid tube 44 may then be coupled with fuel injector housing 30*a*. In embodiments where pilot assembly 40*a* is removably coupled to housing 30*a*, the pilot assembly 40 may also be coupled with housing 30*a*. Any order of assembly may be followed to assemble fuel injector 30. That is, pilot assembly 40 may be coupled to housing 30*a* before the coupling of pilot liquid tube 44 to housing 30*a*, or pilot liquid tube 44 may first be coupled to housing 30*a* before pilot assembly 40 is coupled.

Figure 6A:
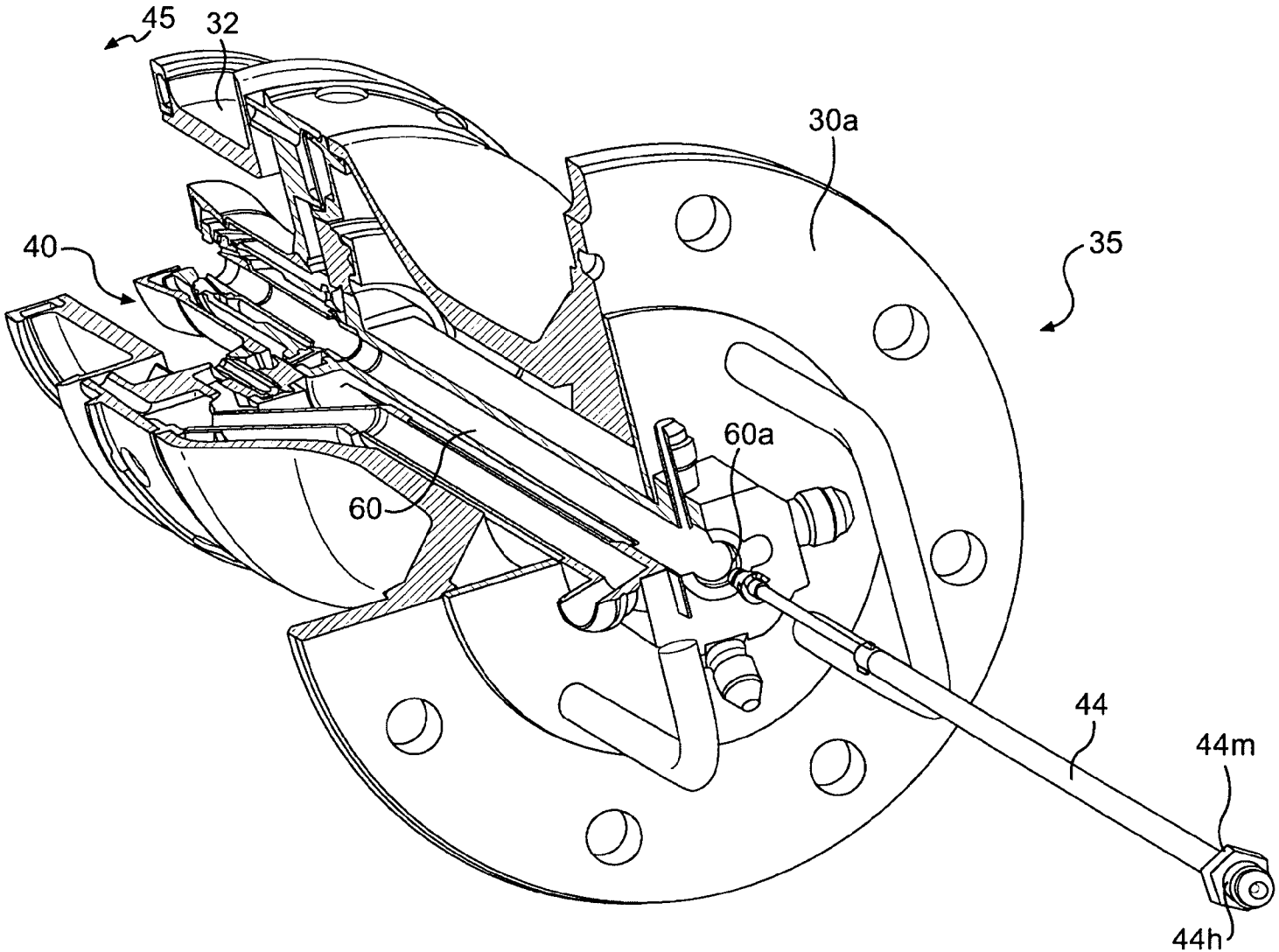
FIG. 6A-6B are illustrations showing the installation of the pilot liquid tube in the fuel injector of FIG. 2.
Figure 6B:
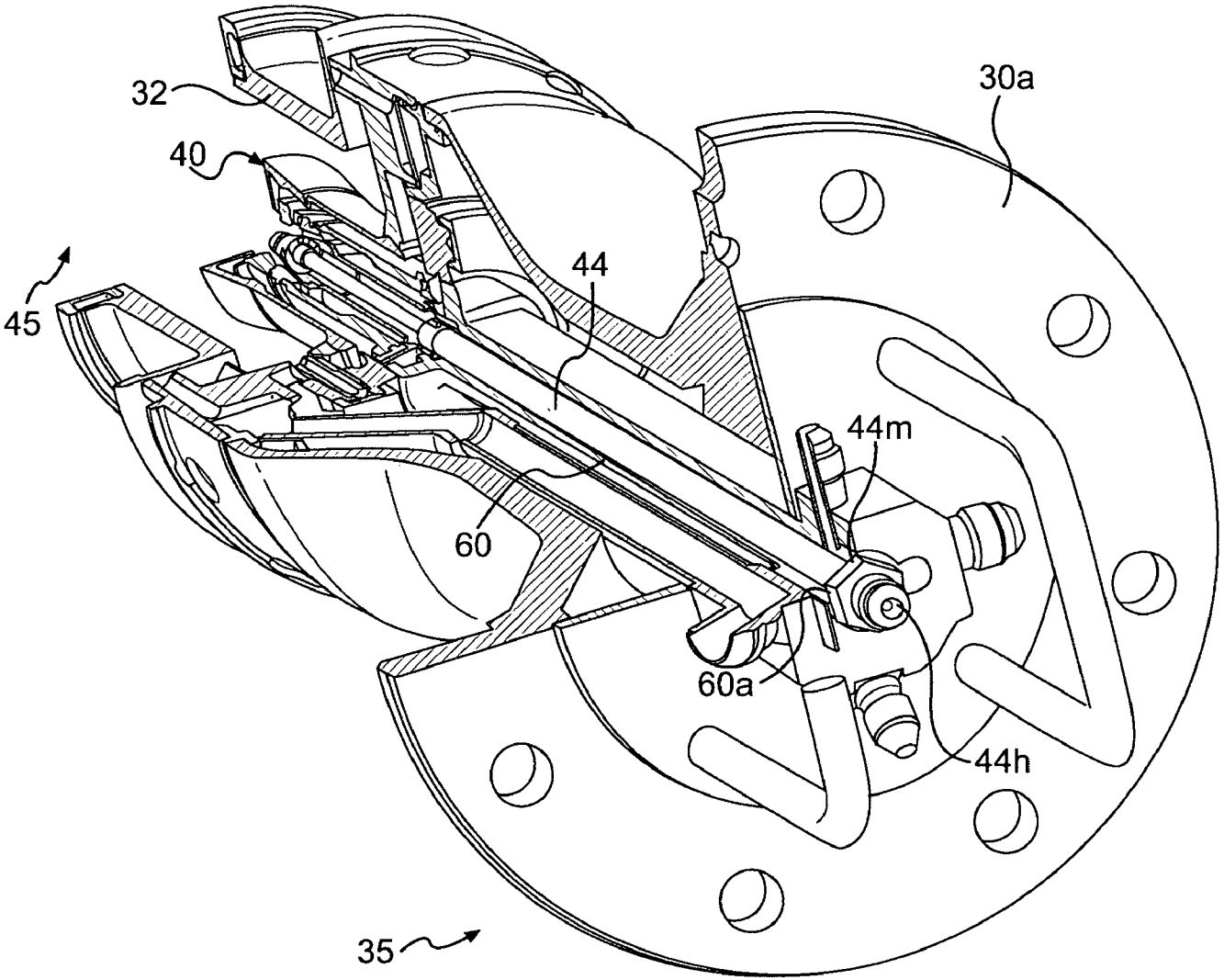

FIGS. 6A-6B illustrates the assembling of pilot liquid tube 44 with fuel injector housing 30*a*. FIG. 6A illustrates an exploded view of fuel injector 30 showing pilot liquid tube 44 poised for installation, and FIG. 6B illustrates the pilot liquid tube 44 installed in fuel injector 40. In the description that follows, reference will be made to both FIGS. 6A and 6B. The end of pilot liquid tube 44 with swirler tip 44*a* may be inserted into a longitudinal cavity 60 on second end 35 of fuel injector 30. Longitudinal cavity 60 may be a cavity that extends from second end 35 of fuel injector 30 to first end 45 along longitudinal axis 98. Longitudinal cavity 60 may be centrally located within fuel injector 30 with premix barrel 32 and pilot assembly 40 annularly disposed around it. When inserted into longitudinal cavity 60, pilot liquid tube 44 may extend from second end 35 to first end 45 of fuel injector 30. If pilot liquid tube 44 is installed on a fuel injector with pilot assembly 40 already installed, external surfaces of swirl features 44*c* (of swirler tip 44*a*) may abut air assist shroud 74 of pilot assembly (see FIG. 3) in the installed orientation. In this orientation, spokes 44*f* (of standoff fixture 44*e*) may also mate with air assist shroud 74 (of pilot assembly 40) to define secondary pilot air duct 66*b* between pilot liquid tube 44 and pilot assembly 40. After pilot liquid tube 44 is inserted into longitudinal cavity 60, external screw threads 44*m* on tube filling 44*h* may be engaged with internal screw threads 60*a* at a proximal end of longitudinal cavity 60. The screw threads may be engaged by rotating pilot liquid tube 44 about longitudinal axis 98 to mate the screw threads together. A tool, such as a wrench, may be applied on the flat surfaces of the second section 44*j* to rotate pilot liquid tube 44. As the screw threads engage, the pilot liquid tube 44 may be drawn towards the first end 45 to press swirl features 44*c* against the abutting surfaces of air assist shroud 74. Tightening the screw threads may snugly couple pilot liquid tube 44 to fuel injector 30. Liquid fuel pipe 55 (attached to a liquid fuel distribution block) may also be coupled with third section 44*k* of tube fitting 44*h* to feed liquid fuel to pilot liquid tube 44. In some embodiments, liquid fuel pipe 55 may be pre-attached to tube fitting 44*h*.

INDUSTRIAL APPLICABILITY

The disclosed gas turbine fuel injector with a removable pilot liquid tube may be applicable to any turbine engine where the ability to disassemble the pilot liquid tube easily may be desired. The disclosed fuel injector may enable the removal and cleaning of a clogged pilot liquid tube in a field environment. The operation of a gas turbine engine with a fuel injector having a removable pilot liquid tube, and the method of removing and installing the pilot liquid tube will now be described.

During operation of GTE 100, air may be drawn into GTE and compressed in compressor system 10 (See FIG. 1). This compressed air may then be directed to combustor system 20 through fuel injectors 30. As the compressed air flows into the injectors through air swirler 42 (FIG. 2), fuel may be injected into the swirled air stream to mix with the compressed air and form a premixed fuel-air mixture. This premixed fuel-air mixture may then proceed through premix barrel 32 to create a flame in combustor 50. For reduced $NO_x$ emissions, the amount of fuel injected into the swirled air stream may be controlled to create a lean premixed fuel-air mixture. This lean premixed fuel-air mixture may create a low temperature flame that may produce reduced $NO_x$ emissions. To prevent unstable combustion and flame extinguishment, a pilot fuel stream may be delivered to combustor 50 through pilot assembly 40.

Liquid fuel from pilot liquid tube 44 may be sprayed into combustor 50 through pilot liquid nozzle 44*b*. This pressurized liquid fuel along with compressed air from pilot air nozzle 66*a*, and swirled compressed air from secondary pilot air duct 66*b* may comprise the pilot fuel stream. The pilot fuel stream may enter combustor 50 through central opening 112. The pressurized fuel and air of the pilot fuel stream may burn at the end of pilot assembly 40 that abuts combustor 50, to form a diffusion flame. The diffusion flame may serve to stabilize the combustion process in combustor 50. Prolonged use of fuel injector 30 in GTE 100 may cause liquid fuel to coke and deposit on the interior surfaces of pilot liquid tube 44. Over time, these deposits may clog the tube and reduce the amount of liquid fuel delivered to combustor 50, thereby affecting the performance of GTE 100. Thus, it may be desirable to clean the clogged pilot liquid tube 44. In addition, proximity to the high temperature diffusion flame may cause damage to pilot liquid tube components.

To detach pilot liquid tube 44 from fuel injector 30, liquid fuel pipe 55 may be detached from pilot liquid tube 44. Tube fitting 44*h* on the second side 35 of fuel injector may then be rotated about longitudinal axis 98 to disengage external screw threads 44*m* (on tube fitting 44*h*) from internal screw threads 60*a* on fuel injector housing 30*a*. After the screw threads are disengaged, pilot liquid tube 44 may be pulled out of longitudinal cavity 60. After removal, internal surfaces of pilot liquid tube 44 may be cleaned. Any cleaning process known in the art, such as air blast, chemical wash, etc., may be used to clean the clogged pilot liquid tube 44. In some cases, it may be desirable to replace pilot liquid tube 44. In such cases, a defective pilot liquid tube may be removed and a new pilot liquid tube 44 used in its place. The cleaned pilot liquid tube 44 may be reinserted into longitudinal cavity 60 and rotated about longitudinal axis 98 to mate external screw threads 44*m* with internal screw threads 60*a*.

The ability to remove the pilot liquid tube 44 from a fuel injector 30 easily may enable the fuel injector 30 to be serviced in the field. The ability to service fuel injector 30 in the field may save time and expense associated with cleaning a clogged pilot liquid tube 44. In addition, the ability to clean a clogged pilot liquid tube 44 easily may decrease the need for extensive fuel filtration techniques to screen solid particles from the liquid fuel. The ability to decouple the pilot liquid tube 44 of a fuel injector 30 may also allow a fuel injector to be refitted with a later developed pilot liquid tube, thereby allowing for upgrading of fuel injector 30.

It will be apparent to those skilled in the art that various modifications and variations can be made to the disclosed fuel injector with a removable pilot liquid tube. Other embodiments will be apparent to those skilled in the art from consideration of the specification and practice of the disclosed fuel injector with a removable pilot liquid tube. It is intended that the specification and examples be considered as exemplary only, with a true scope being indicated by the following claims and their equivalents.

What is claimed is:

1. A fuel injector for a gas turbine engine comprising:

an injector housing having a longitudinal axis, the injector housing including one or more fuel galleries annularly disposed about the longitudinal axis, and a compressed air inlet;

a premix barrel having a proximal end and a distal end circumferentially disposed about the longitudinal axis, the premix barrel being fluidly coupled to the fuel galleries and the compressed air inlet at the proximal end and being configured to couple to a combustor of the gas turbine engine at the distal end;

a substantially cylindrical pilot assembly disposed radially inwards of the premix barrel having a first end and a second end, the second end being coupled to the injector housing and the first end being proximate the distal end of the premix barrel; and a pilot liquid tube having a third end and a fourth end disposed radially inwards of the pilot assembly, the fourth end being removably coupled to the injector housing and the third end being located proximate the first end of the pilot assembly, wherein the fourth end of the pilot liquid tube includes first screw threads on an external surface of the pilot liquid tube, and the injector housing includes second screw threads on an internal surface of the injector housing, the second screw threads on the injector housing mating with the first screw threads on the pilot liquid tube, and the pilot liquid tube is removably coupled to the injector housing by engaging the first screw threads and the second screw threads.

2. The fuel injector of claim 1, wherein the pilot liquid tube includes, an elongate section extending between the third end and the fourth end;

a fuel line coupled to the fourth end, the fuel line being configured to deliver liquid fuel to the pilot liquid tube; and a nozzle coupled to the third end, the nozzle being configured to spray liquid fuel from the pilot liquid tube.

3. The fuel injector of claim 2, wherein the nozzle includes swirl features on an external surface.

4. The fuel injector of claim 3, wherein the swirl features include helical grooves annularly arranged about the longitudinal axis.

5. The fuel injector of claim 2, wherein the elongate section includes two or more tubes coupled together using one or more fluid couplings.

6. The fuel injector of claim 5, wherein the fluid couplings include at least one fluid coupling having a plurality of spokes extending radially outwards from an external surface.

7. The fuel injector of claim 2, wherein the elongate section includes a tube fitting at the fourth end, the tube fitting being attached to the fuel line at one end and being attached to the elongate section at an opposite end, the tube fitting also including screw threads on an external surface.

8. The fuel injector of claim 1, wherein the pilot liquid tube and the pilot assembly form an annular channel between them.

9. A gas turbine engine:

a compressor;

a combustor fluidly coupled to the compressor;

a fuel injector having a longitudinal axis coupled to the combustor, the fuel injector including;

a housing having a front end and a back end, the housing also including a first cavity disposed about the longitudinal axis and extending from the front end to the back end;

a substantially cylindrical premix barrel disposed circumferentially about the longitudinal axis, the premix barrel being coupled to the housing at one end and coupled to the combustor at an opposite end;

a substantially cylindrical pilot assembly disposed radially inwards of the premix barrel, the pilot assembly having a second cavity disposed about the longitudinal axis and passing longitudinally through the pilot assembly; and an elongate pilot liquid tube disposed about the longitudinal axis, the pilot liquid tube being removably coupled to the housing and extending through the first cavity and the second cavity to a location proximate the combustor, wherein the pilot liquid tube includes screw threads on an external surface of the pilot liquid tube which mate with screw threads on an internal surface of the housing; and a turbine fluidly coupled to the combustor.

10. The gas turbine engine of claim 9, wherein the pilot liquid tube includes;

an elongate section having a first end and a second end;

a nozzle coupled to the first end;

a tube fitting at the second end, wherein the screw threads of the pilot liquid tube are on an external surface of the tube fitting, the tube fitting being fluidly coupled to a source of liquid fuel.

11. The gas turbine engine of claim 10, wherein an external surface of the pilot liquid tube and a surface of the second cavity form an annular duct disposed about the longitudinal axis.

12. A fuel injector for a gas turbine engine comprising:

an injector housing including one or more fuel galleries and a compressed air inlet;

a hollow premix barrel extending along a longitudinal axis from a proximal end to a distal end, the proximal end being coupled to the injector housing and the distal end being configured to be fluidly coupled to a combustor of the gas turbine engine;

a hollow pilot assembly extending from a first end to a second end along the longitudinal axis to define a first annular cavity between an inner surface of the premix barrel and an outer surface of the pilot assembly and a inner cavity within the pilot assembly, the first end being coupled to the injector housing and the second end being positioned proximate the distal end of the premix barrel; and an elongate pilot tube extending through the inner cavity from a third end to a fourth end to define a second annular cavity between an inner surface of the pilot assembly and an outer surface of the pilot tube and a central cavity within the pilot tube, the third end including screw threads on an external surface of the pilot tube that engage with screw threads on a mating internal surface of the injector housing, and the fourth end being positioned proximate the second end of the pilot assembly, wherein the fourth end of the pilot tube include swirl features configured to induce a swirl to a fluid passing through the second annular cavity.

13. The fuel injector of claim 12, wherein the screw threads of the pilot tube removably couple the pilot tube to the injector housing.

14. The fuel injector of claim 12, wherein the swirl features include helical grooves on the outer surface of the pilot tube.

15. The fuel injector of claim 12, wherein a portion of the outer surface of the pilot tube between the third end and the fourth end includes one or more spokes that extend radially into the second annular cavity.

16. The fuel injector of claim 12, wherein the elongate pilot tube includes one or more elongate tubes that are coupled together.

17. The fuel injector of claim 12, wherein the third end of the pilot tube includes a coupling that is configured to couple with a fuel line.

18. The fuel injector of claim 17, wherein the elongate pilot tube is configured to be slid out of the hollow pilot assembly from the first end of the pilot assembly.

19. The fuel injector of claim 1, wherein the pilot liquid tube is configured to be slid out of the pilot assembly from the second end of the pilot assembly.

20. The gas turbine engine of claim 9, wherein the elongate pilot tube is configured to be slid out of the pilot assembly from the back end of the housing.

21. The gas turbine engine of claim 10, wherein the nozzle includes swirl features on an external surface.

* * * * *